US011286933B2

(12) United States Patent
Cao et al.

(10) Patent No.: US 11,286,933 B2
(45) Date of Patent: Mar. 29, 2022

(54) MULTI-STAGE COMPRESSOR AND AIR CONDITIONER

(71) Applicants: GREE ELECTRIC APPLIANCES (WUHAN) CO., LTD, Hubei (CN); GREE ELECTRIC APPLIANCES, INC. OF ZHUHAI, Zhuhai (CN)

(72) Inventors: Cong Cao, Guangdong (CN); Tianyi Zhang, Guangdong (CN); Yushi Bi, Guangdong (CN)

(73) Assignees: GREE ELECTRIC APPLIANCES (WUHAN) CO., LTD, Hubei (CN); GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 192 days.

(21) Appl. No.: 16/619,900

(22) PCT Filed: Dec. 25, 2017

(86) PCT No.: PCT/CN2017/118250
§ 371 (c)(1),
(2) Date: Dec. 5, 2019

(87) PCT Pub. No.: WO2018/223667
PCT Pub. Date: Dec. 13, 2018

(65) Prior Publication Data

US 2020/0166033 A1 May 28, 2020

(30) Foreign Application Priority Data

Jun. 5, 2017 (CN) ..... 201710413461.5

(51) Int. Cl.
*F04C 23/00* (2006.01)
*F04C 18/16* (2006.01)
(Continued)

(52) U.S. Cl.
CPC ..... *F04C 23/001* (2013.01); *F04C 29/12* (2013.01); *F04C 2210/22* (2013.01)

(58) Field of Classification Search
CPC ..... F04C 28/26; F04C 23/001; F04C 18/16; F04C 29/12; F04C 11/00; F04C 11/001;
(Continued)

(56) References Cited

U.S. PATENT DOCUMENTS 3,467,300 A * 9/1969 Schibbye ..... F04C 29/0021 418/9
4,694,689 A * 9/1987 Kawasaki ..... G01M 1/04 73/114.77
(Continued)

FOREIGN PATENT DOCUMENTS

CN 1991177 A 7/2007
CN 103174652 A 6/2013
(Continued)

OTHER PUBLICATIONS

Extended European Search Report for European Application No. 17912579.4 dated May 13, 2020 (7 pages).

*Primary Examiner* — Deming Wan
(74) *Attorney, Agent, or Firm* — Stephen Y. Liu; James R. Gourley; Carstens & Cahoon, LLP

(57) ABSTRACT

Disclosed is a multi-stage compressor, including a gas supplement structure, a low-pressure stage chamber and a high-pressure stage chamber. The gas supplement structure includes a gas supplement inlet and a perforated member wherein the gas supplement inlet is arranged at an upstream location of an exhaust gas flow of the low-pressure stage chamber; the perforated member is arranged at a downstream location of the exhaust gas flow of the low-pressure stage chamber; a liquid refrigerant sprayed from the gas supplement inlet is mixed with exhaust gas of the low-pressure stage chamber to impact on the perforated member;
(Continued)

the liquid refrigerant is dispersed, the dispersed liquid refrigerants are re-mixed with the exhaust gas of the low-pressure stage chamber and enter the high-pressure stage chamber.

17 Claims, 5 Drawing Sheets

(51) Int. Cl.

| | |
|---|---|
| ***F04C 28/26*** | (2006.01) |
| ***F04C 29/12*** | (2006.01) |
| ***F04C 11/00*** | (2006.01) |
| ***F04C 29/04*** | (2006.01) |
| ***F04C 29/00*** | (2006.01) |
| ***F04C 15/00*** | (2006.01) |

(58) Field of Classification Search
CPC ..... F04C 11/003; F04C 15/0088; F04C 15/0096; F04C 29/0007; F04C 29/047; F04C 29/042
See application file for complete search history.

(56) References Cited

U.S. PATENT DOCUMENTS

| | | | | |
|---|---|---|---|---|
| 2004/0247465 | A1 | 12/2004 | Yoshimura | |
| 2007/0251256 | A1* | 11/2007 | Pham | F25B 13/00 62/324.1 |
| 2013/0014537 | A1* | 1/2013 | Fujisawa | F04C 29/04 62/468 |

FOREIGN PATENT DOCUMENTS

| | | | | |
|---|---|---|---|---|
| CN | 203430777 | U | 2/2014 | |
| CN | 103629112 | A | 3/2014 | |
| CN | 103673430 | A | 3/2014 | |
| CN | 103673431 | A | 3/2014 | |
| CN | 105864041 | A | 8/2016 | |
| CN | 106168214 | A | 11/2016 | |
| CN | 106989027 | A | 7/2017 | |
| CN | 206801888 | U | 12/2017 | |
| JP | 2008297996 | A | 12/2008 | |
| WO | WO-9835135 | A1 * | 8/1998 | F04C 13/001 |

* cited by examiner

MULTI-STAGE COMPRESSOR AND AIR CONDITIONER

CROSS-REFERENCE TO RELATED DISCLOSURE

This application is a U.S. National Stage of International Application No. PCT/CN2017/118250, filed on Dec. 25, 2017, and published as WO 2018/223667 on Dec. 13, 2018, which claims priority to the Chinese application No. 201710413461.5, titled "Multi-Stage Compressor and Air Conditioner", filed on Jun. 5, 2017. Each application, publication, and patent listed in this paragraph are hereby incorporated by reference in their entireties.

TECHNICAL FIELD

The present disclosure relates to the field of cooling and refrigerating system, and more particularly to a multi-stage compressor and an air conditioner.

BACKGROUND

The double-stage screw compressor achieves a large compression ratio through employing two stages of compression. At present, expanding the operation range has become an innovative trend in developing a compressor. Heat loss and other factors caused in the operation of the compressor lead to reduction of energy efficiency of the compressor. In order to improve the energy efficiency, supplementing gas can be performed on the compressor. For a single-stage compressor, gas is supplemented into a rotor cavity; and for a double-stage compressor, gas is supplemented between two stages of rotors, and simultaneously, the supplemented gas serves to cool the motor.

The inventors have realized that liquid refrigerant is supplemented into the double-stage compressor, and that the sprayed liquid refrigerant cannot be sufficiently mixed with the exhaust gas from the first stage after the liquid refrigerant is sprayed into the compressor from the gas supplement inlet. The non-uniformly mixed fluid enters the secondary compression directly, which causes the flow field of the supplemented gas to be non-uniform and the super-cooling degree of the suction to be too high, affecting the secondary energy efficiency.

SUMMARY

The present disclosure provides a multi-stage compressor and an air conditioner, which are capable of solving a problem that a non-uniform flow field of the implemented gas affects the energy efficiency.

The present disclosure provides a multi-stage compressor, including:

a first-pressure stage chamber;

a second-pressure stage chamber, wherein a pressure in the first-pressure stage chamber is lower than a pressure in the second-pressure stage chamber;

a gas supplement inlet, disposed between the first-pressure stage chamber and the second-pressure stage chamber and configured to supplement fluid; and a perforated member, provided with apertures and disposed between the gas supplement inlet and the second-pressure stage chamber, and the apertures being configured to allow the fluid supplemented from the gas supplement inlet and fluid discharged from the first-pressure stage chamber to pass therethrough.

In one or more embodiments, the perforated member is provided with a plurality of apertures, and a distribution density of the apertures disposed in a region away from the gas supplement inlet is greater than a distribution density of the apertures disposed in a region adjacent to the gas supplement inlet.

In one or more embodiments, the perforated member is provided with a plurality of apertures, and a diameter of the aperture disposed in a region far from the gas supplement inlet is greater than a diameter of the aperture disposed in a region adjacent to the gas supplement inlet.

In one or more embodiments, the perforated member is in a shape of a flat plate.

In one or more embodiments, the perforated member is spiral and configured to guide a liquid refrigerant sprayed from the gas supplement inlet to a region away from the gas supplement inlet.

In one or more embodiments, the perforated member entirely or partially covers a flow area of a gas flow passage between the first-pressure stage chamber and the second-pressure stage chamber.

In one or more embodiments, a plurality of gas supplement inlets are provided and distributed along a circumference of a housing of the multi-stage compressor.

In one or more embodiments, the gas supplement inlet is provided with a detachable sealing plate.

In one or more embodiments, the multi-stage compressor further includes a third-pressure stage chamber, disposed between the first-pressure stage chamber and the second-pressure stage chamber; wherein the gas supplement inlet is disposed in a housing of the third-pressure stage chamber.

In one or more embodiments, the multi-stage compressor is a double-stage compressor.

In another embodiment, the present disclosure provides an air conditioner, including the multi-stage compressor provided by any one of the technical schemes of the present invention.

Based on the above technical solutions, the present disclosure achieves at least following beneficial effects.

The multi-stage compressor provided by the present disclosure includes the gas supplement inlet and the perforated member. The gas supplement inlet is arranged at the upstream position of the exhaust gas flow of the first-pressure stage chamber; the perforated member is arranged at the downstream position of the exhaust gas flow of the first-pressure stage chamber; the liquid refrigerant sprayed from the gas supplement inlet is mixed with the exhaust gas of the first-pressure stage chamber, impacts on the perforated member and is dispersed; the dispersed liquid refrigerant is re-mixed with the exhaust gas of the first-pressure stage chamber, and then enters the second-pressure stage chamber. Accordingly, the liquid refrigerant is fully mixed with the exhaust gas of the first-pressure stage chamber and then enters the second-pressure stage chamber for secondary compression, thereby improving the uniformity of the flow field of the supplemented gas, and improving the secondary energy efficiency.

BRIEF DESCRIPTION OF THE DRAWINGS

The accompanying drawings constituting a part of the present application are provided for further understanding of the present disclosure. The exemplary embodiments of the present disclosure and the description thereof are used to explain the present disclosure, but not intended to limit the present disclosure. In the drawings.

DETAILED DESCRIPTION OF THE EMBODIMENTS

Figure 1:
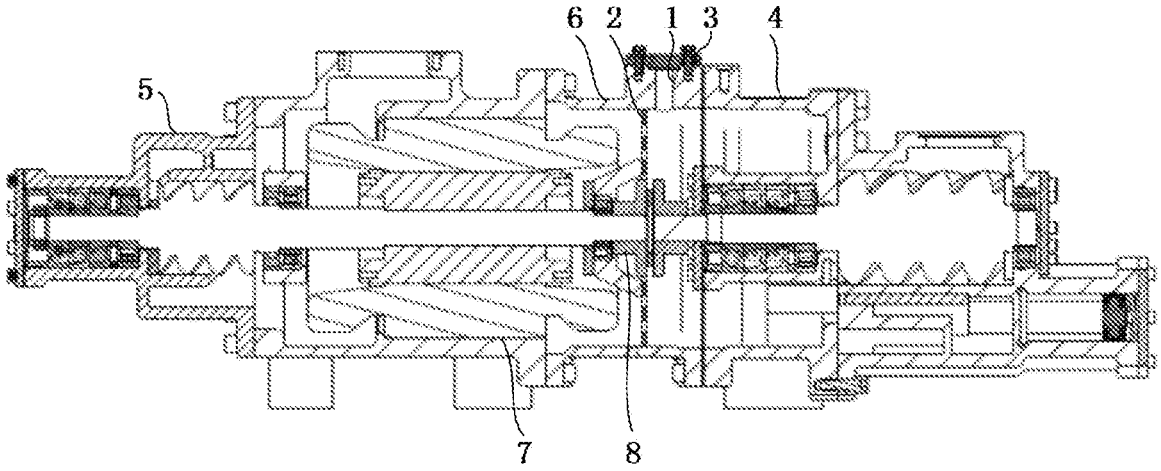
FIG. 1 is a schematic structural view of a double-stage compressor provided by the present disclosure.

The technical solutions in the embodiments of the present disclosure will be described clearly and completely with reference to the accompanying drawings in the embodiments of the present disclosure. Apparently, the described embodiments below are only a part of the embodiments of the present disclosure, and not all embodiments of the present disclosure. All other embodiments obtained by those skilled in the art based on the embodiments of the present disclosure without creative work are within the scope of the present disclosure.

In the description of the present disclosure, it should be understood that orientations or position relationships, indicated by the terms such as "center", "longitudinal", "transverse", "front", "back", "left", "right", "vertical", "horizontal", "top", "bottom", "inside", "outside" and so on, are based on the orientations or position relationships shown in the drawings, and are merely used for conveniently describing the present disclosure and simplifying the description, rather than indicating or implying that the apparatus or element referred to definitely has a particular orientation, is constructed and operated in a particular orientation, and thus are not to be understood to limit the scope of the present disclosure.

The "perforated member 2" in the present disclosure refers to a member that allows gas and liquid to pass therethrough.

FIG. 1 shows an exemplary embodiment of a multi-stage compressor provided by the present disclosure. As shown in FIG. 1, in the exemplary embodiment, the multi-stage compressor includes at least a low-pressure stage component 4 and a high-pressure stage component 5, and a medium-pressure stage component 6 disposed between the low-pressure stage component 4 and the high-pressure stage component 5; the low-pressure stage part 4 and the high-pressure stage part 5 are respectively adjacent to the medium-pressure stage part 6. The low-pressure stage component 4 includes a first-pressure stage chamber and a low-pressure stage housing; the high-pressure stage component 5 includes a second-pressure stage chamber and a high-pressure stage housing; and the medium-pressure stage component 6 includes a third-pressure stage chamber and a medium-pressure stage housing.

The multi-stage compressor is provided with a motor 7, a shaft, a coupling 8, and the like. The motor 7 is disposed at the medium-pressure stage component 6 disposed between the low-pressure stage component 4 and the high-pressure stage component 5, and simultaneously drives two stages of rotors through the coupling 8. The primary compression is performed in the low-pressure stage component 4. The exhaust gas from the first-pressure stage chamber passes through the motor 7 and acts to cool, and is secondarily compressed in the second-pressure stage chamber of the high-pressure stage component 5. However, when the temperature of the exhaust gas from the first-pressure stage chamber is too high, the cooling effect of the motor 7 is not good, therefore in the present disclosure, the cooling is performed by means of a supplemented gas spray.

In one or more embodiments, the multi-stage compressor includes the first-pressure stage chamber, the second-pressure stage chamber, a gas supplement inlet 1 and a perforated member 2. The pressure in the first-pressure stage chamber is lower than the pressure in the second-pressure stage chamber. The gas supplement inlet 1 is disposed between the first-pressure stage chamber and the second-pressure stage chamber, and is configured to supplement fluid. The perforated member 2 is provided with apertures 21 and disposed between the gas supplement inlet 1 and the second-pressure stage chamber. The apertures 21 are configured to allow the fluid supplemented from the gas supplement inlet 1 and the fluid discharged from the first-pressure stage chamber to pass therethrough. The perforated member 2 is configured to allow the fluid to pass therethrough.

In one or more embodiments, the multi-stage compressor provided by the present disclosure includes a gas supplementing structure. The gas supplementing structure is disposed between the first-pressure stage chamber and the second-pressure stage chamber, and specifically, is disposed in the medium-pressure stage component 6 of the multi-stage compressor. The gas supplementing structure includes a gas supplement inlet 1 and a perforated member 2. The gas supplement inlet 1 is disposed at an upstream position of an exhaust gas flow of the low-pressure stage chamber, and specifically, is disposed in the medium-pressure stage housing between the adjacent first-pressure stage chamber and the second-pressure stage chamber. Through the gas supplement inlet 1, the liquid refrigerant sprayed into the third-pressure stage chamber between the first-pressure stage chamber and the second-pressure stage chamber, rather than being sprayed into a rotor chamber, thus, compared with conventional gas supplementing, a larger space is available to mix the fluid.

The perforated member 2 is disposed at a downstream position of the exhaust gas flow from the first-pressure stage chamber, and the liquid refrigerant sprayed from the gas supplement inlet 1 is mixed with the exhaust gas from the first-pressure stage chamber to impact on the perforated member 2; the liquid refrigerant impacts on the perforated member 2 to disperse, and the dispersed liquid refrigerant is re-mixed with the exhaust gas from the first-pressure stage chamber to enter the second-pressure stage chamber, so that the liquid refrigerant can be sufficiently mixed with the exhaust gas from the first-pressure stage chamber before entering the second-pressure stage chamber for secondary compression, thereby improving the uniformity of the flow field of the supplemented gas, and improving the secondary energy efficiency.

In one or more embodiments, the gas supplement inlet 1 is provided with a detachable sealing plate 3. When the temperature of the exhaust gas from the first-pressure stage chamber is lower, and when no gas supplement is required, and no liquid refrigerant is required to be sprayed, the detachable sealing plate 3 can close the gas supplement inlet 1. When the liquid refrigerant is required to be sprayed, the detachable sealing plate 3 can be removed, and the gas supplement inlet 1 is opened and communicates with the gas supplement pipeline. The gas supplement valve in the gas supplement pipeline is opened, and at this time, the liquid refrigerant can be sprayed into the third-pressure stage chamber and mixed with the exhaust gas from the first-pressure stage chamber, and then enters the second-pressure stage chamber for secondary compression.

Figure 2:
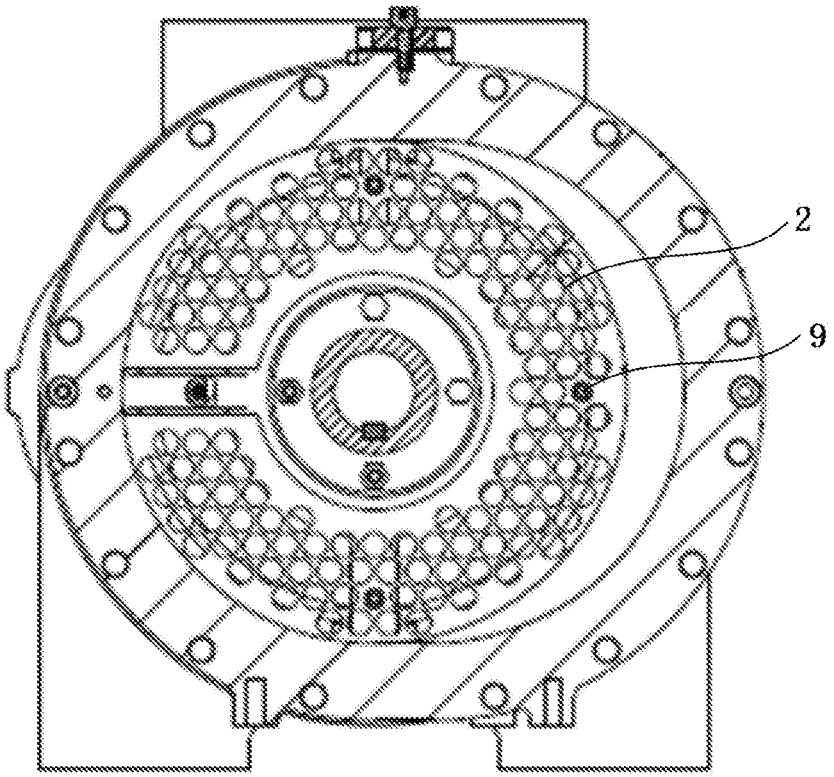
FIG. 2 is a schematic view illustrating an installation position of a perforated member provided by the present disclosure.

In one or more embodiments, as shown in FIG. 2, the perforated member 2 is fixed to the medium-pressure stage housing by a fixing screw 9. The position of the perforated member 2 varies with the adjustment of an angle of the gas supplement inlet 1.

Figure 3:
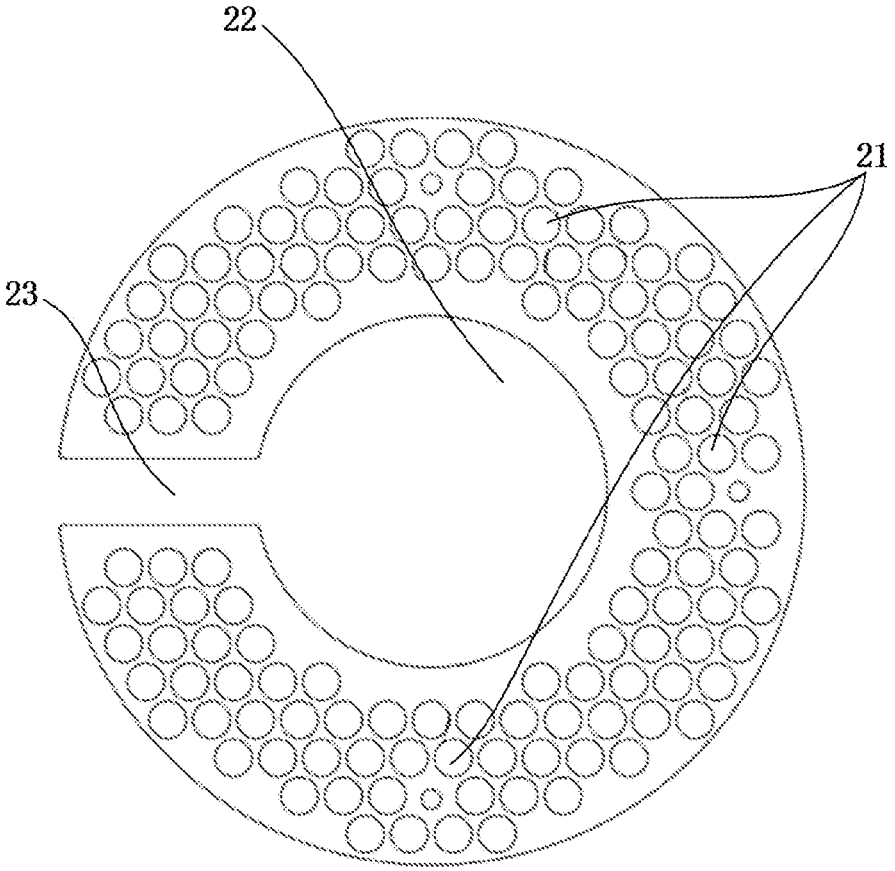
FIG. 3 is a schematic plan view of the perforated member provided by the present disclosure.

As shown in FIG. 3, in the above embodiments, the perforated member 2 is provided with a plurality of apertures 21 allowing the liquid refrigerant and the exhaust gas to pass therethrough. Such arrangement in which a plurality of apertures 21 are provided in the perforated member 2 neither affects the impact of liquid refrigerant on the perforated member 2 and the dispersion, nor hamper the liquid refrigerant from being sufficiently mixed with the exhaust gas and entering the second-pressure stage chamber.

In one or more embodiments, the plurality of apertures 21 are uniformly distributed in the perforated member 2.

In one or more embodiments, in order to further make the liquid refrigerant be uniformly mixed with the exhaust gas of the first-pressure stage chamber to improve the uniformity of the flow field of the supplemented gas, the perforated member 2 is provided with a plurality of apertures 21, and the distribution density of the apertures disposed in a region away from the gas supplement inlet 1 is greater than the distribution density of the apertures disposed in a region adjacent to the gas supplement inlet 1, which can prevent excessive liquid refrigerant from being collected around the gas supplement port 1 and passing through the holes 21 around the gas supplement port 1, thereby enabling the liquid refrigerant to pass through the entire perforated member 2 uniformly.

Through regulating the distribution density of the apertures in the perforated member 2, the above embodiment achieves the effect that the liquid refrigerant passes through the entire perforated member 2 uniformly. In another embodiment, the diameters of the apertures in the perforated member 2 are regulated, so as to achieve the effect that the liquid refrigerant passes through the entire perforated member 2 uniformly. Specifically, the perforated member 2 is provided with a plurality of apertures 21, and the diameter of the aperture 21 disposed in the region far from the gas supplement inlet port 1 is larger than the diameter of the aperture 21 disposed in the region adjacent to the gas supplement inlet 1.

In one or more embodiments, the diameters of the apertures 21 in the perforated member 2 can be adjusted according to different structures. As for a compressor with a large output volume and a large gas supplement volume, the diameters of the apertures can be appropriately increased; and as for a compressor with a small output volume and a small gas supplement volume, the diameters of the apertures can be appropriately reduced, which is determined by a specific condition of the flow field.

In the above embodiments, the multi-stage compressor further includes the third-pressure stage chamber; the third-pressure stage chamber is disposed between the first-pressure stage chamber and the second-pressure stage chamber; the gas supplement inlet 1 is disposed in the housing of the third-pressure stage chamber; the perforated member 2 is disposed in the third-pressure stage chamber. A shaft opening 22 is disposed in the center of the perforated member 2, and configured to keep off the coupling 8 arranged axially inside the multi-stage compressor, thereby ensuring not to interfere with the installation of the coupling 8.

In one or more embodiments, the perforated member 2 is provided with a slot 23 configured to keep off an oil passage; the slot 23 communicates with the shaft opening 22 in the center of the perforated member 2, and is configured to keep off the oil passage in the medium-pressure stage component 6.

In the multi-stage compressor provided by the present disclosure, the perforated member 2, for example, a liquid distributing plate or the like, is configured to uniformly distribute the liquid, so as to make the liquid refrigerant be sufficiently mixed with the exhaust gas from the first-pressure stage chamber, to reduce the super-cooling degree of the suction of the second-pressure stage chamber while the supplemented gas cools the motor 7, thereby improving the energy efficiency of the compressor.

In one or more embodiments, a plurality of gas supplement inlets 1 are provided and distributed along a circumference of the housing of the multi-stage compressor.

In one or more embodiments, the plurality of gas supplement inlets 1 are distributed along a circumference of the medium-pressure stage housing between the first-pressure stage chamber and the second-pressure stage chamber.

In one or more embodiments, the gas supplement inlet 1 is arranged in an upper portion or a lower portion of the medium-pressure stage housing. Taking the gas supplement inlet 1 arranged in the upper portion of the medium-pressure stage housing for an example, the liquid refrigerant, after entering from the gas supplement inlet 1, flows downward, sinks and is mixed with the exhaust gas of the first-pressure stage chamber, and strikes impacts on the perforated member 2 and is dispersed into small drops, and then the small drops enter the second-pressure stage chamber along with the exhaust gas of the first-pressure stage chamber for secondary compression.

In order to ensure the uniformity of the flow field of the supplemented gas at different positions, the structure of the perforated member 2 can be varied.

Figure 4:
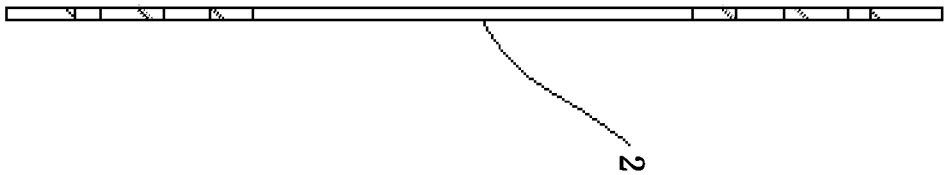
FIG. 4 is a schematic structural view of the perforated member of a first embodiment provided by the present disclosure.

In one or more embodiments, as shown in FIG. 4, the perforated member 2 is in a shape of a conventional flat plate. The perforated member 2 with the shape of flat plate is used for a compressor with small gas supplement space and compact internal space. What's more, such structure of the perforated member 2 with the shape of flat plate has no requirements for the position of the gas supplement inlet 1, and the gas can be supplemented around the perforated member.

In one or more embodiments, as shown in FIGS. 5-8, the perforated member 2 is spiral, and is configured to guide the liquid refrigerant sprayed from the gas supplement inlet 1 to a region away from the gas supplement inlet 1 to be fully mixed with the exhaust gas.

Figure 5:
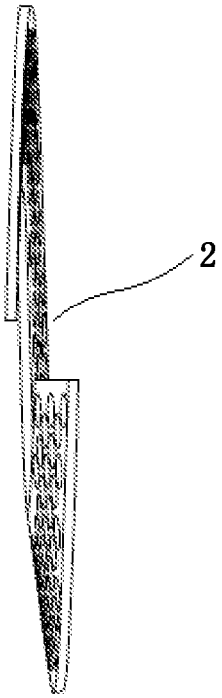
FIG. 5 is a schematic structural view of the perforated member of a perspective view according to another embodiment of the present disclosure.
Figure 6:
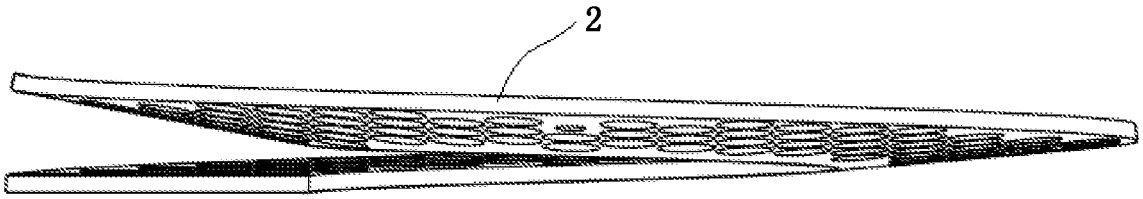
FIG. 6 is a schematic structural view of the perforated member of another perspective view according to another embodiment of the present disclosure.

In one or more embodiments, as shown in FIG. 5 and FIG. 6, the perforated member 2 is in a shape of an upstream spiral surface and mainly applied to a structure that the gas supplement inlet 1 is disposed in the upper half side. After the liquid refrigerant is sprayed, the liquid refrigerant impacts on the perforated member 2, and at the same time, flows spirally downwards along the perforated member 2 clockwise, to be mixed with the exhaust gas of the lower portion, thereby making the flow field uniform.

Figure 7:
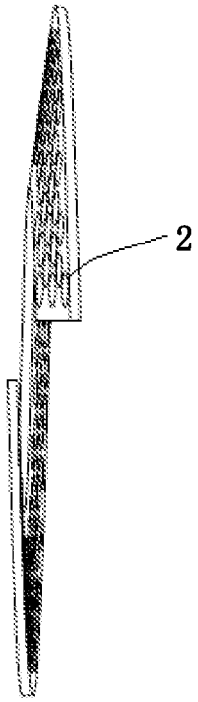
FIG. 7 is a schematic structural view of the perforated member of a perspective view according to another embodiment of the present disclosure.
Figure 8:
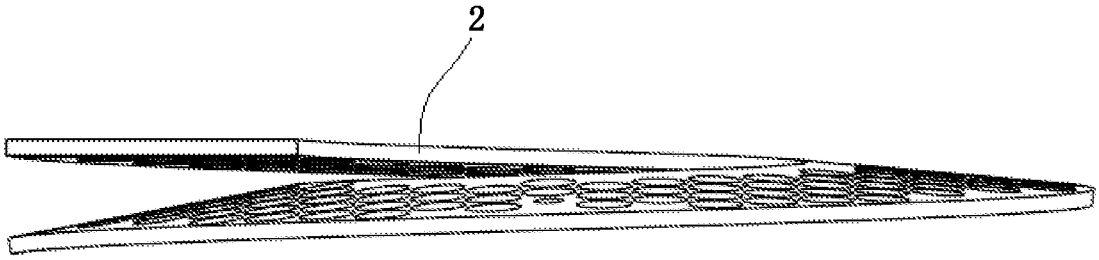
FIG. 8 is a schematic structural view of the perforated member of another perspective view according to another embodiment of the present disclosure.

In one or more embodiments, as shown in FIG. 7 and FIG. 8, the perforated member 2 is in a shape of a downstream spiral surface and mainly applied to a structure that the gas supplement inlet 1 is disposed in the lower half side. After the liquid refrigerant is sprayed, the liquid refrigerant is mixed with the exhaust gas of the lower portion and flows spirally upwards along the perforated member 2 anticlockwise, thereby ensuring the upper half of the motor 7 to be cooled.

From the above, the perforated member 2 has various forms of structure. In practical applications, the form of structure of the perforated member 2 can be selected and used according to requirements.

In one or more embodiments, on the basis of the embodiments described above, the perforated member 2 entirely or partially covers the flow area of a gas flow passage between the first-pressure stage chamber and the second-pressure stage chamber.

During installation, the perforated member 2 is fixed to the medium-pressure stage housing with screws 9, and the installation sequence can be adjusted according to actual conditions. The perforated member 2 can be fixed first, or can be fixed after the installation of the mediate-pressure stage component 6 is completed and before the low-pressure stage component 4 is installed.

When the perforated member 2 with the shape of a flat plate is provided, it can be fixed with the screws 9 from three positions. When the spiral perforated member 2 is provided, since the plate surface is spiral, the perforated member 2 cannot be ensured to be mounted on the same surface, thus it is required to adopt screws 9 with different lengths and add washers, to ensure that the perforated member 2 does not vibrate under the impact of the gas flow, and thereby reducing the vibrations and noise.

In each of the above embodiments, the perforated member 2 is formed by stamping a steel sheet, to ensure the strength of the perforated member.

The multi-stage compressor provided by the present disclosure is a double-stage compressor.

In one or more embodiments, the gas supplement inlet 1 is disposed in the upper portion of the median-pressure stage housing of the double-stage compressor. In order to ensure the uniformity of the flow field of the supplemented gas, the perforated member 2 is arranged inside the double-stage compressor, so that the sprayed liquid refrigerant impacts on the perforated member 2 and is dispersed, then the dispersed liquid refrigerant is fully mixed with the exhaust gas of the first-pressure stage chamber, and finally flows into the second-pressure stage chamber, thereby ensuring the motor 7 to be cooled and improving the operation stability while improving the performances of the double-stage compressor, In this way, there is no need to arrange a complex fixing structure in the double-stage compressor casting, and the assembly can be completed by using a casting stiffener.

Another embodiment of the present disclosure provides an air conditioner including the multi-stage compressor provided by any one of the technical solutions of the present disclosure.

In the description of the present disclosure, it should be understood that the orientations or position relationships indicated by the terms such as "center", "longitudinal", "transverse", "front", "back", "left", "right", "vertical", "horizontal", "top", "bottom", "inside", "outside" and so on, are based on the orientations or position relationships shown in the drawings, and are merely used for conveniently describing the present disclosure and simplifying the description, rather than indicating or implying that the apparatus or element referred to definitely has a particular orientation, is constructed and operated in a particular orientation, and thus are not be understood to limit the scope of the present disclosure.

Finally, it should be noted that the above-described embodiments are only examples for illustrating the technical solutions of the present disclosure, but not intended to limit the present disclosure. Although the present disclosure is described in detail with reference to the preferable embodiments, it should be understood by those skilled in the art that several modifications of the specific embodiments of the present disclosure or replacements of partial technical features may be made without departing from the spirits of the technical solutions of the disclosure, and all modifications or replacements are within the scope of protection of the present disclosure.

What is claimed is:

1. A multi-stage compressor, comprising:

a first-pressure stage chamber;

a second-pressure stage chamber, wherein a pressure in the first-pressure stage chamber is lower than a pressure in the second-pressure stage chamber;

a gas supplement inlet, disposed between the first-pressure stage chamber and the second-pressure stage chamber and configured to supplement a fluid; and a perforated member, provided with a plurality of apertures and disposed between the gas supplement inlet and the second-pressure stage chamber, the plurality of apertures being configured to allow the fluid supplemented from the gas supplement inlet and a fluid discharged from the first-pressure stage chamber to pass therethrough, wherein the perforated member is provided with the plurality of apertures, and a distribution density of the apertures disposed in a region away from the gas supplement inlet is greater than a distribution density of the apertures disposed in a region adjacent to the gas supplement inlet.

2. The multi-stage compressor according to claim 1, wherein the perforated member is provided with the plurality of apertures, and a diameter of the aperture disposed in the region far from the gas supplement inlet is greater than diameter of the aperture disposed in the region adjacent to the gas supplement inlet, the perforated member, provided with apertures and disposed between the gas supplement inlet and the second-pressure stage chamber, the apertures being configured to allow the fluid supplemented from the gas supplement inlet and a fluid discharged from the first-pressure stage change to pass therethrough.

3. The multi-stage compressor according to claim 1, wherein the perforated member is in a shape of a flat plate.

4. The multi-stage compressor according to claim 1, wherein the perforated member is spiral and configured to guide a liquid refrigerant sprayed from the gas supplement inlet to the region away from the gas supplement inlet.

5. The multi-stage compressor according to claim 4, wherein the perforated member is in a shape of an upstream spiral surface, and the gas supplement inlet is disposed in an upper half side.

6. The multi-stage compressor according to claim 4, wherein the perforated member is a shape of a downstream spiral surface, and the gas supplement inlet is disposed in a lower half side.

7. The multi-stage compressor according to claim 1, wherein the perforated member entirely or partially covers a flow area of a gas flow passage between the first-pressure stage chamber and the second-pressure stage chamber.

8. The multi-stage compressor according to claim 1, wherein a plurality of gas supplement inlets are provided and distributed along a circumference of a housing of the multi-stage compressor.

9. The multi-stage compressor according to claim 1, wherein the gas supplement inlet is provided with a detachable sealing plate.

10. The multi-stage compressor according to claim 1, further comprising:

a third-pressure stage chamber, disposed between the first-pressure stage chamber and the second-pressure stage chamber; wherein the gas supplement inlet is disposed in a housing of the third-pressure stage chamber.

11. The multi-stage compressor according to claim 1, wherein the multi-stage compressor is a double-stage compressor.

12. An air conditioner, comprising the multi-stage compressor of claim 1.

13. The air conditioner according to claim 12, wherein the perforated member is provided with the plurality of apertures and a distribution density of the apertures disposed in the region away from the gas supplement inlet is greater than a distribution density of the apertures disposed in the region adjacent to the gas supplement inlet.

14. The air conditioner according to claim 12, wherein the perforated member is provided with the plurality of apertures, and a diameter of the aperture disposed in the region far from the gas supplement inlet is greater than diameter of the aperture disposed in the region adjacent to the gas supplement inlet.

15. The air conditioner according to claim 12, wherein the perforated member is spiral and configured to guide a liquid refrigerant sprayed from the gas supplement inlet to a region away from the gas supplement inlet.

16. The multi-stage compressor according to claim 1, wherein a shaft opening is disposed in a center of the perforated member and configured to keep off a coupling arranged axially inside the multi-stage compressor.

17. The multi-stage compressor according to claim 16, wherein the perforated member is provided with a slot configured to keep off an oil passage, and the slot communicates with the shaft opening.

* * * * *